United States Patent [19]

Montano

[11] Patent Number: 4,829,972

[45] Date of Patent: May 16, 1989

[54] MAGNET-FLYWHEEL IGNITION UNIT FOR INTERNAL COMBUSTION ENGINES

[75] Inventor: Giacomo Montano, Livorno, Italy

[73] Assignee: Piaggio & C. S.p.A., Genova, Italy

[21] Appl. No.: 117,603

[22] Filed: Nov. 6, 1987

[30] Foreign Application Priority Data

Dec. 5, 1986 [IT] Italy ..... 22595

[51] Int. Cl.[4] ..... F02P 3/06

[52] U.S. Cl. ..... 123/599; 123/620; 315/209 CD; 315/218

[58] Field of Search ..... 123/599, 601, 620; 315/209 CD, 218

[56] References Cited

U.S. PATENT DOCUMENTS

| | | | |
|---|---|---|---|
| 3,861,373 | 1/1975 | Allwang et al. | 123/601 |
| 3,893,439 | 7/1975 | Chudoba | 123/599 |
| 4,478,200 | 10/1984 | Nagashima et al. | 123/599 |
| 4,538,586 | 9/1985 | Miller | 123/620 |

FOREIGN PATENT DOCUMENTS

| | | | |
|---|---|---|---|
| 60-67769 | 4/1985 | Japan | 123/599 |

*Primary Examiner*—Andrew M. Dolinar

*Attorney, Agent, or Firm*—Diller, Ramik & Wight

[57] ABSTRACT

In a magnet-flywheel, capacitive-discharge ignition unit, for internal combustion engines, besides a high-impedance winding intended for feeding the capacitor connected to the primary winding of the ignition coil, also a low-impedence winding is provided, which is connected to the primary winding, and has the task of prolonging the ignition discharge.

4 Claims, 1 Drawing Sheet

Fig.1
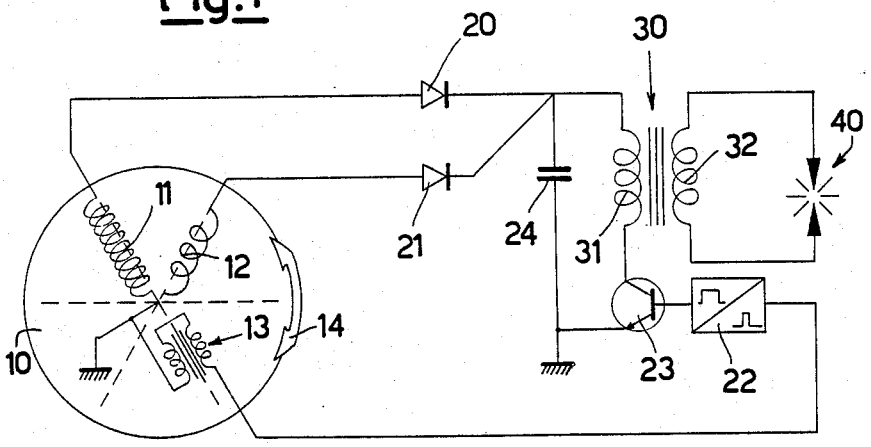
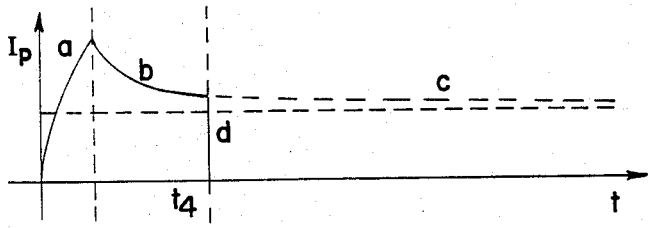
Fig.2
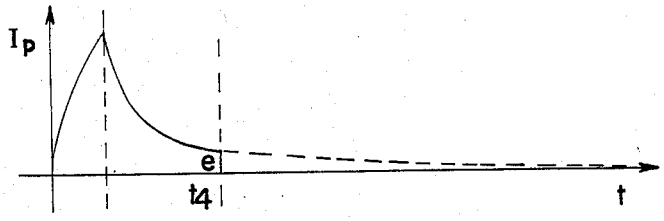
Fig.3
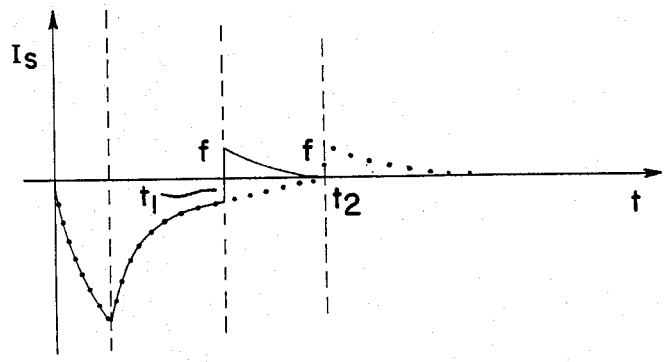
Fig.4

MAGNET-FLYWHEEL IGNITION UNIT FOR INTERNAL COMBUSTION ENGINES

The present invention relates to a magnet-flywheel ignition unit for internal combustion engines.

The ignition systems for internal combustion engines have shown, in particular during the last years a progressive enhancement in level of performances and of reliability, a development which has been supported by the development of electronic technology and which has also been dictated by the need for increase in efficacy of the spark causing the ignition of the compressed mixture, in engines having higher and higher specific power, and fed with lean mixtures.

It is known that from classic battery-ignition methods, which have been used and continuously improved over more then a half century, engine manufacturers have moved, with the accession of silicon transistors having disruptive voltages higher than 500 V and collector currents higher than 10 A, to transistor-supported electronic ignitions, wherein the energy was still stored in an inductance, but in a higher amount, thanks to the higher current the transistor allowed to flow, as compared to traditional points; it should be observed that the points continued to exist in the wiring harness of such ignition units, but they were requested to only interrupt the very low currents necessary to drive the transistor, so that, in the overall, besides the advantage of the higher energy available on the primary winding of transformed coil, a higher life of same points was obtained, thus, in the overall, a higher reliability of the system being achieved.

After such ignition types, capacitive-discharge electronic ignitions have come, in which a capacitor connected in series to the primary winding of transformer coil is charged by a supply voltage higher than that used in prior ignition units, and is then discharged through the coil by short-circuiting it onto same coil, by means of a controlled diode. The higher supply voltage, allowed by the low value of the time constant necessary for energy storage in capacitor, allows the turns ratio to be decreased as compared to the transistor-supported system, and allows low-price components to be used, such as controlled diodes able to support voltages of the order of 350 V and currents of the order of 100 A.

Besides the above financial advantages, it should be considered that the capacitive-discharge ignition, thanks to the low rise times of the wave shape of voltage at spark-plug electrodes, makes the system suitable to ignite the mixture also in case the electrodes are fouled by carbonaceous substances, or oil deposits; the above is still more useful in case of two-stroke internal combustion engines, wherein precisely said ignition systems have been more widely adopted.

The parameter by means of which the system capability to be indifferent to spark-plug fouling and by which, more generally, an ignition system is characterized, is the "utility factor", which is defined as the inverse of the minimum resistance value of a resistor which, when parallelled to the electrodes, allows at least ten consecutive discharges to follow each other, without interruptions occurring, with the electrodes being positioned at 5 mm of distance from each other.

For the three ignition types as described above, it can be assumed, for said parameter, an average value of 3 for the traditional ignition system, of 7 for transistor supported ignition, and of 30 for capacitive-discharge ignition, thus the enormous progresses being evidenced, which have been achieved in ignition systems with the accession of electronic ignitions, and, in particular, of capacitive-discharge ignitions.

It is known as well that, besides the utility factor, the parameters regarded as useful to define an ignition system are total energy, open-circuit voltage and charge time, and that the ignition systems presently used in internal combustion engines are characterized by energy values comprised within the range of from 20 to 130 mjoules, open-circuit voltages of the order of 40 kV, and discharge times of the order of 500 μsec.

In particular, the maximum values of above cited quantities are obtained with capacitive-discharge ignitions.

The even high values of energy and discharge time which can be obtained by means of the capacitive discharge system are however still by the engine manufacturers regarded as insufficient for particular engine types. What is required in particular, is a longer spark duration, with the same steepness of the rise front and of the voltage peak value on secondary winding; a characteristic which appears to be antithetical in capacitive-discharge ignitions; in fact, in such ignitions, the advantage of the rise front steepness and of the high voltage value, is contrasted by the disadvantage of a short discharge time.

Purpose of the present invention is to propose a capacitive-discharge magnet-flywheel ignition unit which, besides the characteristics of discharge rise front steepness, and of high discharge voltage value, has the characteristic of a relatively long discharge time, and at the same time is simple from the circuitry viewpoint, and consequently structurally cheap.

Such a purpose is achieved by means of a magnet-flywheel ignition unit for internal combustion engines, comprising an ignition coil with a primary winding, capacitive means connected to said primary winding, a magnet-flywheel comprising at least a high-impedance winding connected to said capacitive means, destined to charge these latter, and furthermore comprising at least one magnetic pick-up connected to said capacitive means through interrupter means, and driving said interrupter means in order to control the charging of said capacitive means by means of said high-impedance winding and the interruption of power supply to said primary winding or to drive the discharge of said capacitive means on said primary winding, characterized in that said magnet-flywheel comprises furthermore at least one low-impedance winding connected to said primary winding and destined to feed this latter during the discharge of said capacitive means on said primary winding.

Hereunder, an exemplifying, not limitative practical embodiment of the present invention is shown, as illustrated in the hereto attached drawing table, wherein:

FIG. 1 shows a schematic view of a magnet-flywheel ignition unit according to the invention;

FIGS. 2, 3 and 4 are charts relating to the pattern of current in particular branches of ignition unit circuit of FIG. 1.

The ignition unit of FIG. 1, destined to be applied to a single-cylinder engine, e.g., of a motor-scooter, comprises the true magnetic flywheel, indicated with 10, and the ignition coil 30, connected to the ignition spark-plug 40.

The magnet-flywheel 10 comprises, in its stationary portion, a high-impedance winding 11, a low impedance winding 12, and, finally, a magnetic pick-up 13.

The magnet-flywheel 10 comprises furthermore, in its revolving portion, permanent magnets, of which one only, indicated with 14, is shown, which interact with the said windings 11, 12 and with the magnetic pick-up 13 according to a well-known principle.

The windings 11 and 12 are connected, through respectively a diode 20 and a diode 21, with one end of primary winding 31 of ignition coil 30. The magnetic pick-up is connected, through a clipping and shaping circuit 22, with the base of a transistor 23. The collector of transistor 23 is connected with the other end of primary winding 31. In series to primary winding 31, capacitive means are then provided, which are constituted by a capacitor 24 connected, a one end, with diodes 20 and 21, and, at the other end, with the emitter of transistor 23.

The operation of the disclosed ignition unit takes place in a cyclic fashion, with cycle times inversely proportional to engine revolution speed, in the following way.

Starting from the time at which transistor 23 is turned into the interdiction status, the step begins of capacitor 24 charging by means of energy coming from winding 11 of generator 10, such a winding actually generating a high-maximum-value alternating voltage; through diode 20, the positive half-wave of such a voltage is transferred to ends of capacitor 24, which is hence charged to a value close to said maximum value.

The energy which is generated in this step at ends of winding 12 does not contribute to charge capacitor 24, inasmuch as it has a voltage value much lower than that coming from winding 11.

From the time at which transistor 23 is turned into conduction status, in primary winding 31 of ignition coil 30 a current $I_p$ is abruptly generated, which is mainly due to the energy stored in capacitor 24, and has the pattern over time as shown in FIG. 2; the steep rise front "a" is typical for capacitive-discharge ignitions; to it, a peak of induced voltage in secondary winding 32 corresponds, which is sufficient to trigger the ignition spark under conditions of considerable fouling of the electrodes of spark-plug 40. During the pursuance of the discharging step, the pattern of current $I_p$, indicated with "b" in FIG. 2, shows traces, and hence the contribution, of the low-impedance winding 12; the current $I_p$, in fact, decreases according to a curve which would asymptotically tend to a value different from zero, according to short-dashes-line "c".

In the absence of a low-impedance winding 12, the pattern would be the one as shown in FIG. 3; i.e., it would asymptotically tend to zero.

Winding 12, by having a low impedance supplies indeed the primary winding 31 with a current having lower intensity, but longer duration than that supplied by capacitor 24. At the time of opening of transistor 23, such a time being indicated with $t_1$ in FIGS. 2 and 3, the interrupted current, in the real case of FIG. 2, has a value "d", much higher than value "e" which one would experience in the absence of the low-impedance winding 12 (FIG. 3), thus the induced electromagnetic force, by being proportional to the derivative of current over time, would be, in second case, of much lower value; even, should the opening time $T_1$ result more delayed relatively to time of transistor 23 conduction beginning, such an induced electromagnetic force would result practically zero: fact which cannot absolutely occur in the real case relating to the described ignition unit. From that, therefore, tee establishing derives definitely of a new overvoltage at the ends of secondary winding 32, and a conseguent prolongation of the spark, which is justified, from an energetic point of view, thanks to the energy stored in the primary magnetic field, due to the effect of the current precisely coming from the low-impedance winding 12.

One has, in this way, besides a steepness in rise front, and a high voltage value, also a relatively long discharge time. We stress that such a result is obtained by means of a very simple, and hence, also cheap, circuit, on considering that such a low-impedance winding is naturally present when it is a matter of engines installed on two-wheelers, or, generally, of applications relating to the use of small two-stroke engines, wherein such a low-impedance winding constitutes the generator feeding the service loads of vehicle.

Clearly, in order to obtain the pattern over time of FIG. 2, a particular mutual angular positioning shall be necessary of windings 11, 12 and of magnetic pick-up 13, within the reach of one skilled in the art.

From examination of FIG. 4, relating to the pattern over time of current $I_s$ in secondary winding 32 of ignition coil 30, a peculiarity of use of ignition unit of FIG. 1 can be deduced.

In fact, in such a Figure, represented are, by a continuous line, and by a dotted line, the two wave forms relating to said current, both in case the interdiction time $t_1$ of transistor 23 occurs before the secondary current consequent to the capacitive discharge may have been completely nullified, and in case such an interdiction time, now indicated as $t_2$, occurs after the nullifying of current in secondary winding, but before the nullifying of current in primary winding. In both of cases, a current of equal intensity arises, due to the sudden change of current, from a certain value to zero value in the primary winding, which then decreases exponentially to zero value; but, whilst in the first case the consequent spark represents in practice a prolongation of the original spark of capacitive character, in the second case, the triggering occurs, on the contrary, of a second spark, in that the first one has been completely extinguished, as it is precisely demonstrated by the zero value of current in the secondary winding.

Such a fact can be, in some circumstances, a desired and suitably induced situation; the effect deriving from it is, in fact, a post-combustion, which, as known, may result useful, e.g., to pollution prevention purposes.

This effect is precisely achieved thanks to the prolongation of current flow through the secondary winding, by means of the low-impedance winding.

The ignition unit as disclosed and illustrated can feed more than one ignition spark-plugs, for applications to multi-cylinder engines, obviously with the addition of proper spark-distributing means.

A plurality of high-impedance windings, and a plurality of low-impedance windings may be used.

Interrupter means equivalent to transistor may be provided to the purpose of driving the capacitor discharges.

I claim:

1. A magnetic-flywheel ignition unit for internal combustion engines comprising an ignition coil having a primary winding, capacitive mean connected to said primary winding for feeding discharge current to said primary winding; a rotatable magnetic-flywheel including high-impedance winding means, low-impedance winding means and magnetic pick-up means; said high-impedance winding means being connected to said capactive means for charging said capacitive means, said high-impedance and low-impedance winding means being connected in parallel to each other and to said primary winding, and said magnetic pick-up means being connected to said capacitive means through electronic switch means to operate said electronic switch means (a) for controlling the charging of said capacitive means to substantially maximum voltage by said high-impedance winding means and (b) for supplying low intensity current to drive the discharge of said capacitive means on said primary winding by said low-impedance winding means to thereby prolong ignition discharge.

2. Ignition unit according to claim 1, wherein said high-impedance winding and said low-impedance winding are connected to capacitive means and to said primary winding through rectifier means.

3. Ignition unit according to claim 2, wherein said ignition coil comprises a secondary winding inductively coupled with said primary winding, said magnetic pick-up driving said interrupter means to switch the power supply to said primary winding after the nullifying of current inside said secondary winding.

4. Ignition unit according to claim 1, wherein said ignition coil comprises a secondary winding inductively coupled with said primary winding, said magnetic pick-up driving said switch means to interrupt the power supply to said primary winding after the nullifying of current inside said secondary winding.

* * * * *